US005673631A

United States Patent [19]

Guns et al.

[11] Patent Number: 5,673,631

[45] Date of Patent: Oct. 7, 1997

[54] TABLE JOINING LEAF

[76] Inventors: Louis L. Guns; Margaret Guns, both of P.O. Box 591, Carbondale, Colo. 81623

[21] Appl. No.: 645,092

[22] Filed: May 13, 1996

[51] Int. Cl.[6] ..... A47B 57/00

[52] U.S. Cl. ..... 108/64; 108/66

[58] Field of Search ..... 108/64, 69, 65, 108/66

[56] References Cited

U.S. PATENT DOCUMENTS

| | | | |
|---|---|---|---|
| 5,341,750 | 8/1994 | Fuchs | 108/64 |
| 5,485,795 | 1/1996 | Williams | 108/66 X |

FOREIGN PATENT DOCUMENTS

| | | | |
|---|---|---|---|
| 1463176 | 12/1966 | France | 108/64 |
| 2300521 | 10/1976 | France | 108/64 |
| 2704123 | 10/1994 | France | 108/66 |

*Primary Examiner*—Jose V. Chen

*Attorney, Agent, or Firm*—Ramon L. Pizarro; Edwin H. Crabtree

[57] ABSTRACT

A table joining leaf for joining a pair of round tables as well as for joining a round table to a table having straight edges. The table joining leaf includes a pair of a first panel of a thin material. The first panel includes an upper surface, a lower surface, a first end and a second end. The first end is adapted for attaching the first panel to an edge of a table. The second end of the panel is adapted for attachment to a splice panel. The splice panel includes an upper surface, and a lower surface. The lower surface of the splice panel is adapted for attachment to the second end of the first panel, so that a pair of the first panels may be placed over a the joint area between a pair of tables to be joined. The pair of first panels may be laid over the joint area of tables to be joined, and the splice panel allows the pair of first panel to be adjusted in order to provide a smooth transition when the joining of a pair of round tables or a round table and a table having straight edges.

13 Claims, 5 Drawing Sheets

TABLE JOINING LEAF

BACKGROUND OF THE INVENTION (a) Field of the Invention

This invention generally relates to field of devices for connecting tables together, and more particularly, but not by way of limitation, to a device for temporarily joining round tables together or joining a square table to a round table.

(b) Discussion of the Prior Art

Restaurants and caterers often have to accommodate the needs of the parties for whom they are helping entertain. However, out of economic necessity, these businesses typically use a few standard sized tables to accommodate their needs. Consequently these businesses often find themselves unable to adequately accommodate large parties who wish to seat at one large table, and therefore, the restauranteur or the caterer has to join tables to seat everyone together.

While joining tables, however, it is often encountered that only round tables are being used, and that these tables cannot be adequately joined together because they will not form a desirable oval shape.

In yet other situations, in order to maximize the occupancy of the restaurant, the restaurant will use a combination of round tables in center areas and fixed square or rectangular tables along the walls or edges of the restaurant. In these situations the restauranteur is often faced with trying to join a round table to a square or rectangular table.

To date, several approaches at providing table joining devices have been introduced. For example, in U.S. Pat. No. 3,714,906 to Finestone the use of a system for joining round tables by using a leaf with and edge to edge connection system that is adapted for accepting a specific diameter table. The Finestone device, however, while providing a novel system for joining table, leaves many needs unanswered. For example, the Finestone device requires that the user buy new tables which can accept the system. Also, the Finestone does not allow the connection of a round table to a square or rectangular table.

In another approach, U.S. Pat. No. 5,146,855 to Morgan teaches the use of one or more fill-in pieces to join round table tops. This approach offers great advantages over the prior art, however, it still can accommodate only round tables. Still yet another limitation of the Morgan device is that it is not designed for accepting different diameters of round tables. Still further, another disadvantage of the Morgan device is that it can require a significant number of parts which must be stored at the restaurant, thereby taking up valuable square footing for the storage of the device. Still further, the Morgan device should be used with specialized tables with convex edges, meaning that the restauranteur would have to replace the existing tables with tables that could accept the Morgan device.

Other approaches at the problem are taught in French patents Nos. 2,232,179 to Maisons du Perigord SA and 1,463,176 to Lalanne. These approaches, however, are directed at systems which join only round tables of a specific diameter, and do not join round tables to square or rectangular tables or round tables of different diameters.

Yet another disadvantage of the known devices for joining tables is that many of the devices are not easy to install due to the number of parts which must be aligned in order to attach the devices properly. This can be particularly serous in the restaurant business where prompt service is important to the customer and to the restauranteur's ability to serve more customers.

Thus the need to devise a system or apparatus for joining round tables to square tables, round table to round table, or round tables of different diameters has not been met by the known prior art. Importantly, there remains a need for a device that can be installed quickly and easily.

Moreover, the known devices for connecting tables can be heavy, thus increasing the risk of back injury to the installer. Therefore, there remains a need for a table joining device that is light and can be easily installed by anyone at the restaurant.

Also, there remains a need for a device that does not take up very much storage room and that does not require the use of specialized tables.

SUMMARY

It has been discovered that the above needs, which had been left unsatisfied by the known prior art, can be solved by providing a table joining leaf which includes:

a) a pair of mating panels, each mating panel being of a thin material and having an upper surface, a first end and a second end, the first end being attachable edge of a table, the upper surface of the mating panels having attachment means near the second end of each of the mating panels; and b) a splice panel having an upper surface, and a lower surface, the lower surface of the splice panel includes an attachment means which allows the splice panel to attach to the attachment means near the second end of each of the mating panels, so that the pair of mating panels may be placed over and adjusted to join a pair of round tables or a round table and a table having straight edges by joining the mating panels by joining the attachment means of splice panel with the attachment means of the pair of mating panels.

In an embodiment of the invention a table joining leaf for joining a pair of round tables or joining a round table to a table having straight edges is taught. The table joining leaf according to this embodiment includes:

a first thin panel with an upper surface and a lower surface, a first end and a second end, the first end having a ridge;

a second thin panel having an upper surface and a lower surface, a first end and a second end, the first end having a ridge, the second end being arranged relative to the second end of the first panel in an overlapping manner with the second end of the first panel;

track means for allowing telescoping motion, said track means having a first and a second end, the first end of said track means being attached to the lower surface of said first panel, and the second end of said track means being attached to the lower surface of said second panel, so that the first panel and the second panel may be placed over and adjusted along said track means to join a pair of round tables or a round table and a table having straight edges, and so that a gap is eliminated wile making adjustments by the overlapping of the second end of the second panel over the second end of the first panel.

Thus it will be understood by scientists, engineers, and those skilled in the art that the disclosed invention uses thin panels which can be placed over the tables to be joined. The thin panels may preferably include tapered edges in order to provide an unobtrusive joint which can be easily concealed under a pad which is typically under a tablecloth that is used over the assembly.

The use of a pair of thin panels allows the fabrication of a single, stackable set of panels which can be used two at a time. Thus allowing the restauranteur to save space by storing several of the panels in a stacked fashion in a waiting station, for example.

Importantly, the invention may be used with a restauranteur's existing tables, and thus alleviating the financial burden of having to purchase new tables in order to gain the ability to join tables.

Also, it is important to note that the instant invention will give the restauranteur the ability to join tables which could not be joined with the devices in the known prior art. Still further, with the instant invention one may now join round tables of different sizes as well as round tables to tables having straight sides.

Moreover, now with this summary it will become apparent that the disclosed invention is simple, inexpensive to manufacture, and very easy to install.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
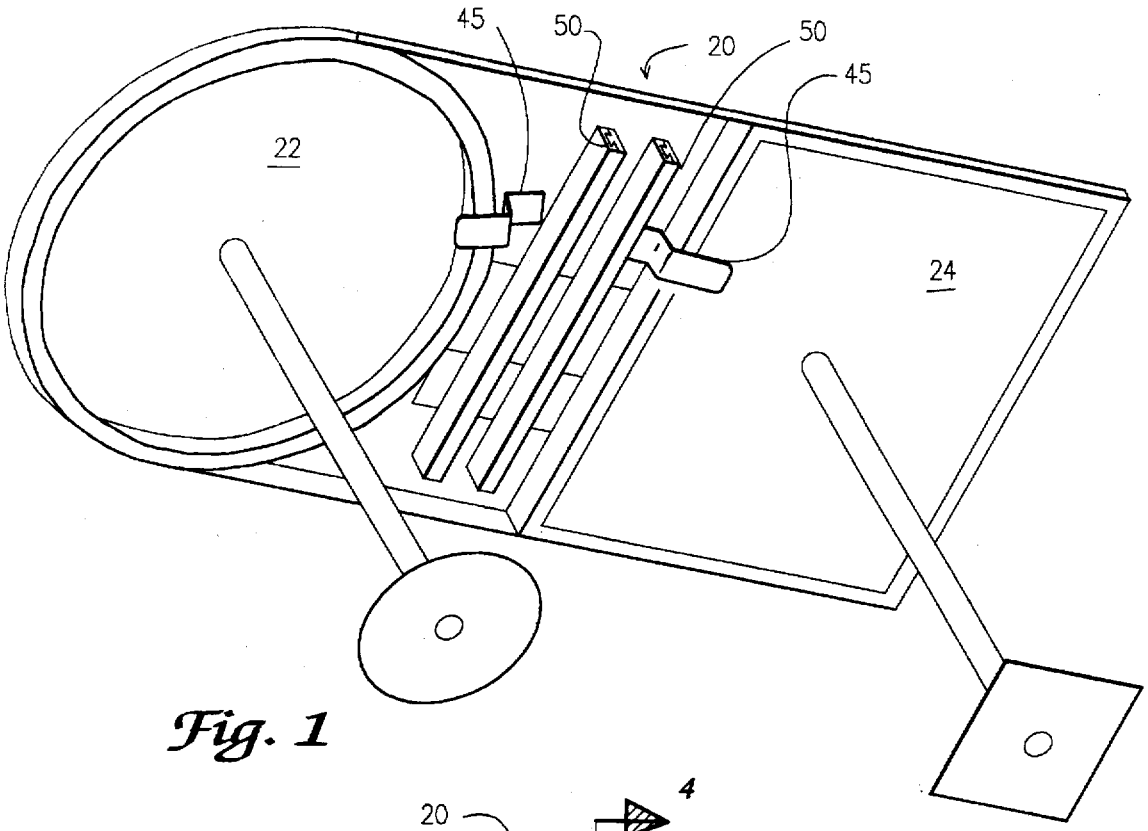
FIG. 1 is a perspective view of the underside of a square table joined to a round table with the instant invention.

As can be seen in FIG. 1 an embodiment of a table joining leaf 20 made in accordance with the principles taught herein is shown joining a pair of tables. As illustrated in FIG. 1, the table joining leaf may be used for joining a round table 22 to a table having straight edges, such as a square table 24.

Figure 2:
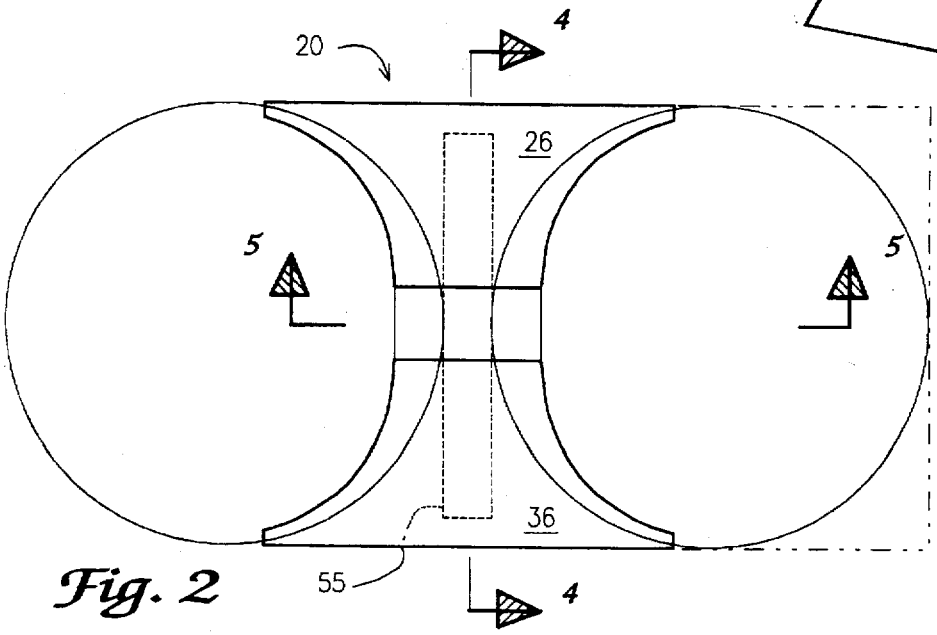
FIG. 2 is a top view of an embodiment of the invention, the view including outlines of connections to a round or a square table.

Turning now to FIG. 2, which further illustrates the uses of the table joining leaf 20, it can be seen that the table joining leaf 20 can be used to join round tables to round tables as well as round tables to tables having straight edges, such as square tables. The illustrated embodiment of the table joining leaf 20 includes a first panel 26 having an upper surface 28, a first end 30 and a second end 32. The first end 30 of the first panel 26 includes means for engaging the edge of a table, which in a preferred embodiment includes art angled edge 34 which serves to attach to an edge of a table and as a means for providing a smooth transition between the tables to be joined.

The embodiment of the table joining leaf illustrated in FIG. 1 also includes a second panel 36 which, like the first panel 26, has an upper surface 38, a first end 40 and a second end 42. The first end 40 of the second panel 36 also includes means for engaging the edge of a table, which in a preferred embodiment is an angled edge 44 which serves to attach to an edge of a table and as a means for providing a smooth transition between the tables to be joined.

Figure 3:
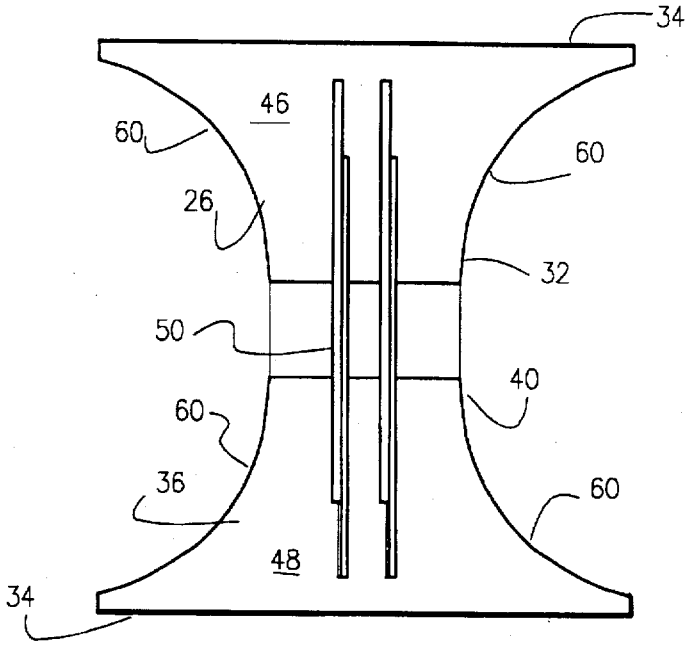
FIG. 3 is a bottom view of an embodiment of the invention, the illustration showing the connection of a pair of panels with a pair of telescoping tracks.
Figure 4:
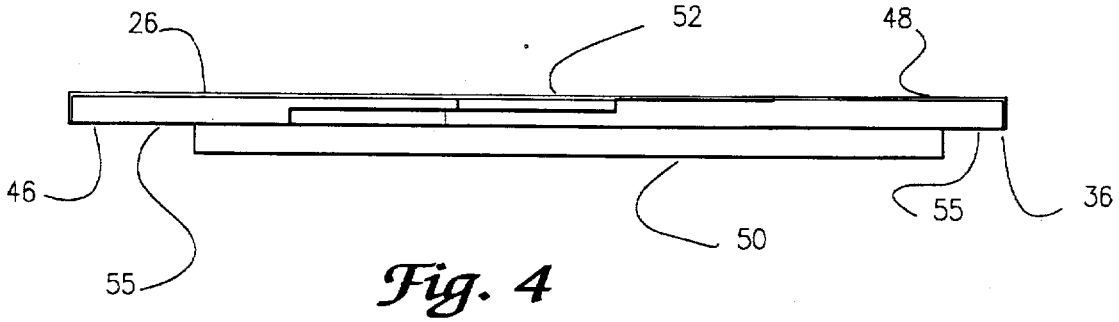
FIG. 4 is a sectional view of the embodiment of the invention, the section taken along line 4—4 as shown on FIG. 2.
Figure 5:
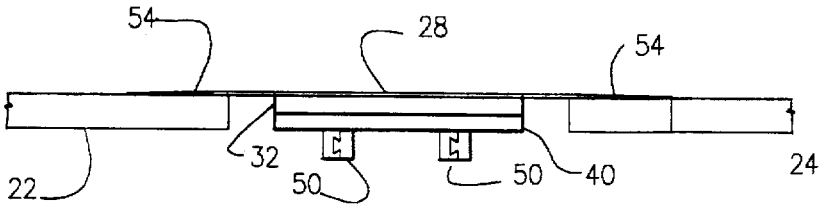
FIG. 5 is a sectional view of the embodiment of the invention, the section taken along line 5—5 as shown on FIG. 2.
Figure 6:
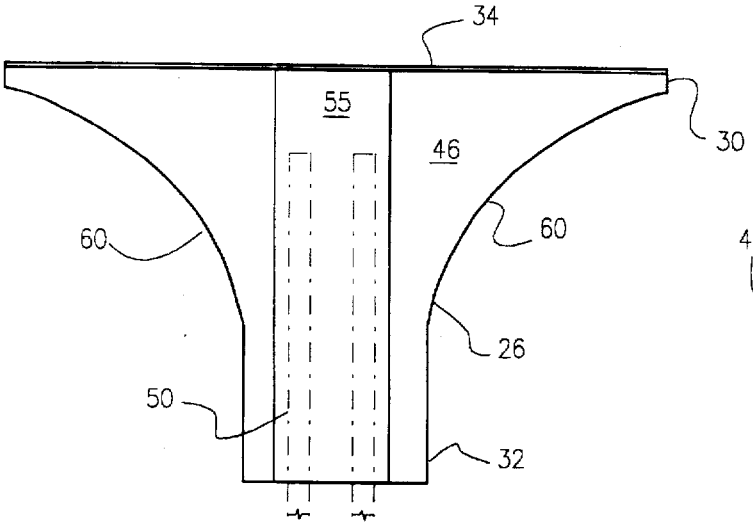
FIG. 6 is a bottom view of an embodiment of the invention, the embodiment including mating overlapping sections which allow expansion of the invention, an outline of the location of telescoping tracks is also shown.
Figure 7:
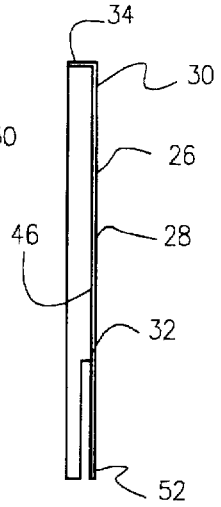
FIG. 7 is a side view of the embodiment shown on FIG. 6.

Referring now to FIGS. 3 through 5, where it has been illustrated that the first panel 26 also includes a lower surface 46, and that the second panel 36 also includes a lower surface 48. Attached to the lower surface 46 of the first panel 26 and to the lower surface 46 of the second panel 36 is at least one track means 50 for allowing telescoping motion. The track means 50 have a first end 52 and a second end 54 and have been shown mounted on a thickened pad 55 on the panels. The thickened pad 55 prevents cracking or breaking of the panels due to stress concentrations introduced by the attachment of the track means 50. The first end 52 of the track means 50 is preferably attached to the lower surface 38 of the first panel 26, and the second end 54 of the track means 50 is attached to the lower surface 48 of the second panel 36. This arrangement allows adjustment of the distance between the first panel 26 and the second panel 36 in order to accommodate different sizes of tables.

As illustrated in FIG. 1, attached the lower surface 46 of the first panel 26 and to the lower surface 48 of the second panel 36 is a pair of adjustable clasps 45 which serve as means for clamping the first panel 26 to one of the tables and the second panel 36 to the other table in order to prevent accidental separation of the tables. It is important to note that the illustrated means for clamping are merely one of may different means which may be used for ensuring that the tables do not accidentally wander apart. Thus it is contemplated that means such as suction cups or straps with hook and loop material ("hook and loop" as used herein shall mean a section of material with hooks, a mating section of material with loops or both) may also be used to ensure that the tables do not separate from one another.

While it is contemplated that many different means for preventing the tables from sliding away from one another while in use with a table joining leaf as taught herein. It is contemplated that a single strap around the table's central support or legs may be used to join the tables. It is also contemplated that a portion of hook and loop material be permanently attached, by means of an adhesive backing for example, to the underside of tables to be used with the invention. This would allow two tables to be butted up against each other and a strap with hook and loop material would then be conveniently attached between the two tables. This connection would prevent the tables from wondering or slipping away from each other while being connected by a table joining leaf made in accordance with the principles taught herein.

In FIGS. 4 and 5 it is shown that a splice panel 52 may be used between the first panel 26 and the second panel 36. The splice panel 52 serves to cover the opening formed by the adjusting of the distance between the first panel 26 and the second panel 36, and may preferably be made of a thin rigid material so that it may also support articles placed over it when using the two tables together. The term "thin" as used herein shall mean material that is preferably less than ⅜ of an inch thick, and preferably ¼ of an inch thick or less, and most preferably ⅛ of an inch thick or less.

In order to lend strength to assembled table joining leaf 20, so that the table joining leaf 20 can support a table centerpiece, for example, one preferred embodiment of the invention is configured so that the second end 32 of the first panel 26 overlaps the second end 42 of the second panel 36. With this configuration, heavy loads placed over the center of the device may be supported by the telescoping track means 50, which will extend immediately below the area where the second end 32 of the first panel 26 overlaps the second end 42 of the second panel 36.

As has been partially illustrated in FIG. 5, a preferred embodiment of the splice panel 52, as well as edges of the of the first panel 26 and the second panel 36 include a chamfer or taper 54 at edges which lie over the surface of the joined tables. The taper 54 allows unobtrusive installation of the table joining leaf 20 over a pair of tables, covering up any gap between the two tables. Thus the first panel 26 and the second panel 36, together with the splice panel 52, are used to cover up any gap between the tables by covering, or bridging, any gap between the tables.

Figure 10:
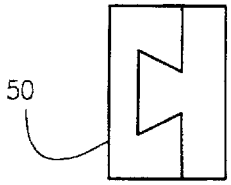
FIG. 10 is an end view of an embodiment of the telescoping tracks which may be used with the invention.
Figure 8:
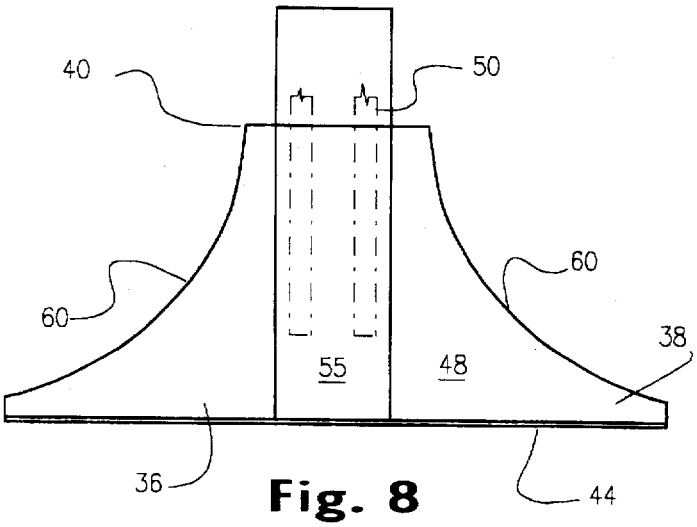
FIG. 8 is a bottom view of a panel that mates with the embodiment of the invention shown on FIG. 6, the embodiment including mating overlapping sections which allow expansion of the invention, an outline of the location of telescoping tracks is also shown.
Figure 9:
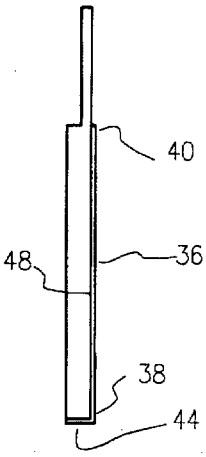
FIG. 9 is a side view of the embodiment shown on FIG. 8.

A preferred embodiment of the invention uses telescoping track means 50, and thus FIG. 10 illustrates one possible embodiment of the arrangement of the track means 50 which may be used. The configuration shown on FIG. 10 has the advantage of being easily fabricated from wood, for example. This kind of fabrication would allow fastening or glueing of the track means 50 to the lower surface 46 of the first panel 26 and to the lower surface 48 of the second panel 36.

Figure 11:
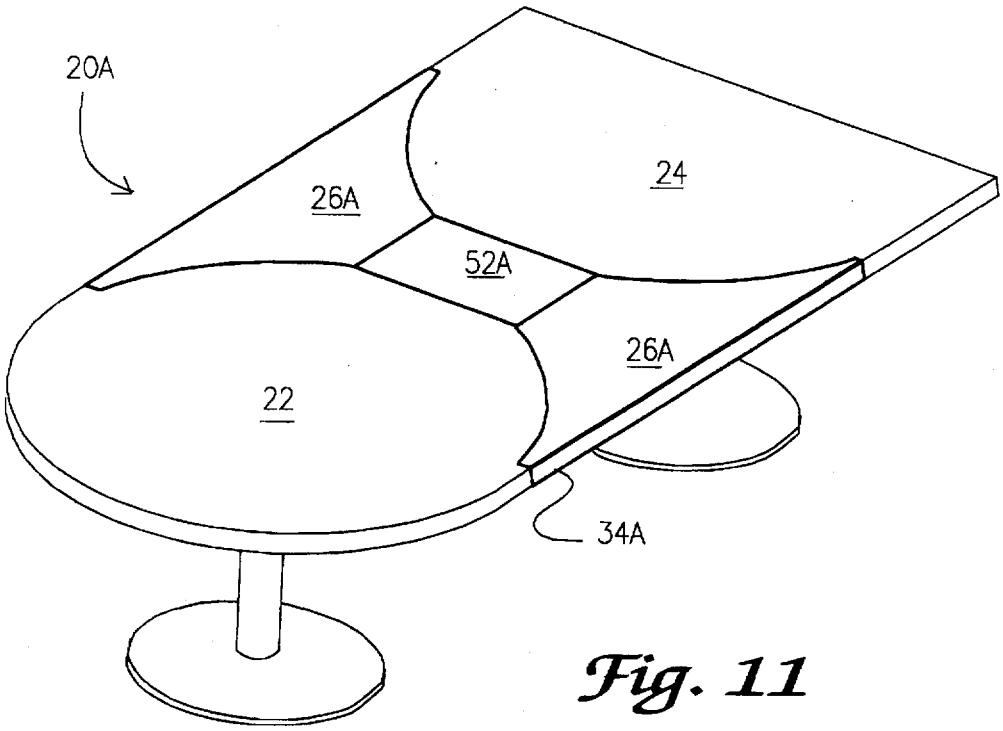
FIG. 11 is a perspective view of another embodiment of the invention, the embodiment including a pair of identical panels connected together with a splice panel.
Figure 12:
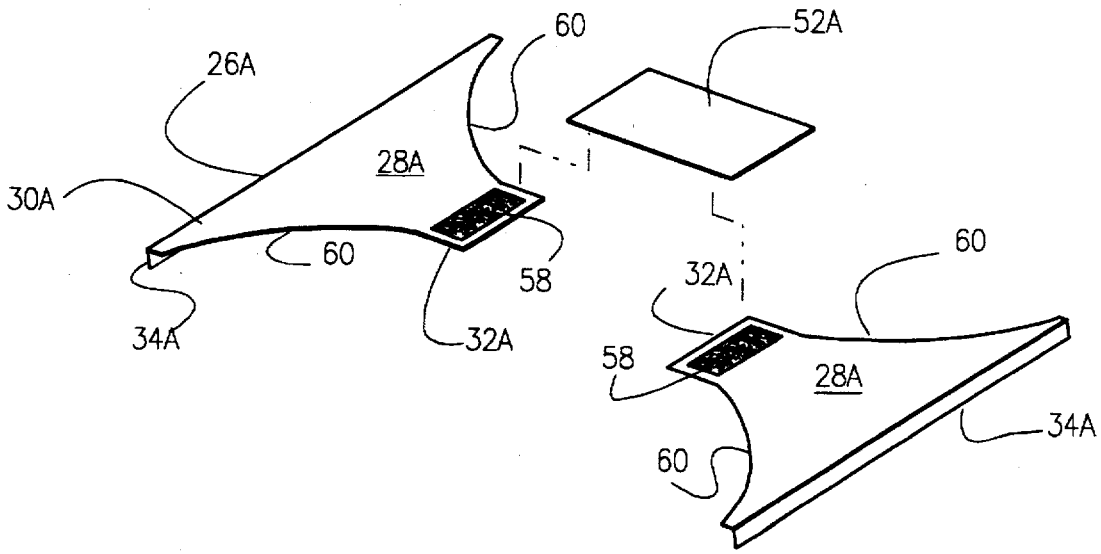
FIG. 12 is an exploded view of the elements used with the embodiment shown on FIG. 11.

Turning now to FIGS. 11 and 12, where yet another embodiment of the instant table joining leaf 20A has been illustrated. In the embodiment shown on FIGS. 11 and 12, includes a first panel 26A which is made of a thin rigid material such as a fiber reinforced plastic, sheet metal, or laminated wood. The thinness of the material allows the first panel 26A to be set over a table without presenting an obtrusive profile over the table. Moreover, it is contemplated that the edges of the first panel 26A which lie over the surface of the table may include a chamfered or tapered area which would further alleviate the possibility of having the table joining leaf 20A protrude from under a tablecloth. Still further, it is contemplated that a pliable table pad may be placed over the joined tables and the table joining leaf 20A before placing a tablecloth over the joined tables.

The illustrated embodiment of the first panel 26A of the table joining leaf 20A includes an upper surface 28A, a first end 30A and a second end 32A. The first end **30*a* of the first panel 26A includes means for engaging the edge of a table, which in a preferred embodiment includes an angled edge 34A** which serves to attach to an edge of a table and as a means for providing a smooth transition between the tables to be joined.

The embodiment of the table joining leaf 20A illustrated in FIGS. 11 through 15 also includes second end 32A. The second end 32A includes an attachment means, which in a preferred embodiment is an area of hook or loop material 58, which may be hook and loop material sold under the trademark Velcro.

As has been illustrated in FIG. 12 a splice panel 52A is also used with this embodiment of the table joining leaf 20A. The splice panel 52A is also preferably made from a thin rigid material such as a fiber reinforced plastic, sheet metal, or laminated wood so that it will not be obtrusive over the surface of a pair of joined tables. Also, the edges of the splice panel 52A may also include chamfers or tapers in order to reduce the obtrusiveness of the table joining leaf 20A.

Figure 13:
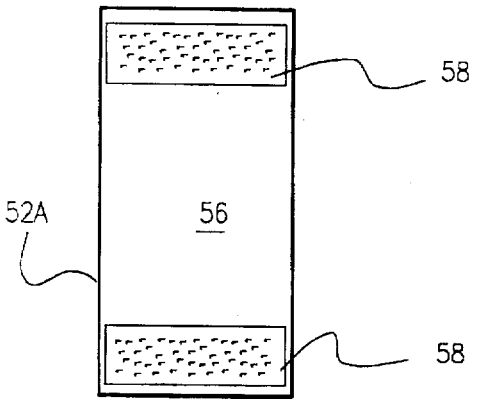
FIG. 13 is a bottom view of the splice panel, the splice panel showing the placement of hook and loop attachment means.
Figure 14:
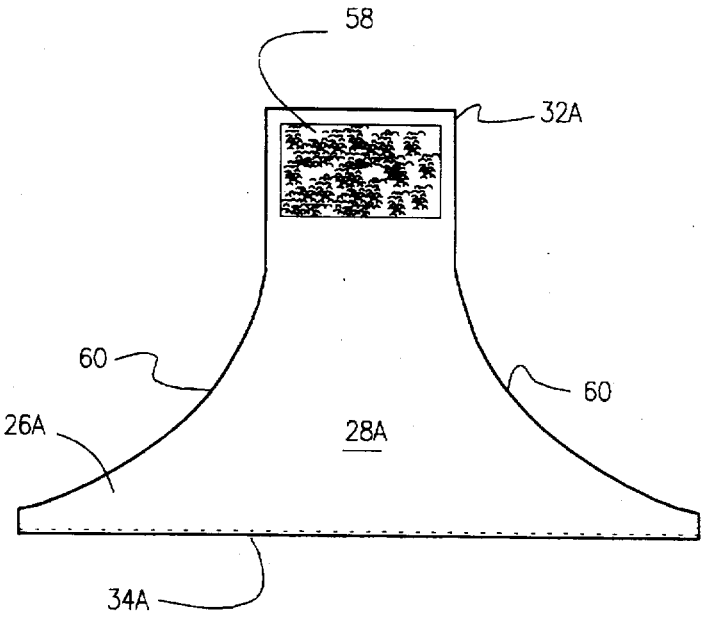
FIG. 14 shows a plan view of a panel of the pair of panels used to connect tables with an embodiment of the invention.

As has been illustrated in FIGS. 12 and 13, the splice panel 52A includes a lower surface 56. On the lower surface 56 of the splice panel 52A are mounted attachment means, which in a preferred embodiment also includes at least one area of hook or loop material 58. The hook or loop material 58 on the splice panel 52A to allows the splice panel 52A to attach to the attachment means on the second end 32A of the first panel 26A. This configuration allows the use of a pair of first panels 26A and the splice panel 52A to join a pair of round tables or a round table and a table having a straight edge.

Thus to connect a pair of tables one would simply butt the tables against one another and then place one of the first panels 26A between the two tables in the manner shown on FIG. 11 and the other first panel 26A between the tables so that the second end 32A of each of the first panels 26A are near one another. One would then place the splice panel 52A between the pair of first panels 26A in order to allow the hook and loop material to join the panels together, and thus join the pair of round tables or a round table and a table having straight edges. Thus the panels 26A and the splice panel 52A are used to cover up any gap between the tables by covering, or bridging, any gap between the tables.

Figure 15:
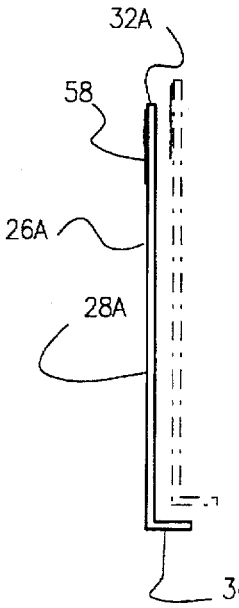
FIG. 15 is a side view of the embodiment shown on FIG. 14.

Referring now to FIGS. 15 it can be seen that a side view of a an embodiment of the first panel 26A is generally "L" shaped, which allows stacking several first panels 26A in order to facilitate storage. Thus it should become apparent that it is important that the material used for forming the first panel 26A be thin material. Thin material allows accommodation of the round or tables with straight edges below the first panel 26A or the first panel 26 and second panel 36 without resulting in an unsightly protrusion over the joined area.

It should be noted that while the figures have shown a generally arcuate or hyperbolic shape at edges 60 of the first panel 26A or the first panel 26 and second panel 36. It is preferred that the arcuate shape not be circular, but at least approach a hyperbolic shape. This shape allows the table joining device to accommodate a variety of table diameters. While it is contemplated that the shape of the edges 60 could be straight lines, it has been found that the use of a generally arcuate or hyperbolic shape produces a lighter, less obtrusive device which can accommodate different diameters of round tables, including joining tables of different diameters, as well as joining round tables to tables with straight edges.

Thus it can be appreciated that the disclosed table joining leaf can be used over the joint area between two tables to be joined. By providing a device that fits over the joint area one can join round tables to round tables, as well as round tables to tables having a straight edges.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A table joining leaf for joining a pair of round tables as well as for joining a round table to a table having straight edges, the table joining leaf comprising:

a pair of a first panel having an upper surface, a lower surface, a first end and a second end, the first end having means for attaching to an edge of a table, the second end having an attachment means;

a splice panel having an upper surface, and a lower surface, the lower surface having an attachment means for mating with the attachment means of said first panel, so that said pair of first panels may be placed over and adjusted to cover any gaps between the tables, produced when joining a pair of round tables or a round table and a table having straight edges by joining said splice panel to the second end of each of said pair of first panels by the attachment means.

2. A table joining leaf according to claim 1 wherein said first panel is of a thin substantially rigid material.

3. A table joining leaf according to claim 2 wherein said attachment means comprises hook and loop material.

4. A table joining leaf according to claim 3 wherein said first panel further comprises a clamping means for attaching to a table, the clamping means being attached to the lower surface of the first panel.

5. A table joining leaf for joining a pair of round tables as well as for joining a round table to a table having straight edges, the table joining leaf comprising:

a first panel having an upper surface and a lower surface, a first end and a second end, the first end having a ridge, the second end having attachment means;

a second panel having an upper surface and a lower surface, a first end and a second end, the first end having a ridge, the second end having attachment means;

track means for allowing telescoping motion, said track means having a first and a second end, the first end of said track means being attached to the lower surface of said first panel, and the second end of said track means being attached to the lower surface of said second panel;

a splice panel having an upper surface, and a lower surface, the lower surface having an attachment means for mating with the attachment means of said first panel and the attachment means of said second panel, so that said first panel and said second panel may be placed over and adjusted along said track means to join a pair of round tables or a round table and a table having straight edges.

6. A table joining leaf according to claim 5 wherein said first panel and said second panel are of a thin substantially rigid material.

7. A table joining leaf according to claim 6 wherein said attachment means comprises hook and loop material.

8. A table joining leaf according to claim 7 wherein said first panel further comprises a clamping means for attaching to a table, the clamping means being attached to the lower surface of the first panel.

9. A table joining leaf for joining a pair of round tables as well as for joining a round table to a table having straight edges, the table joining leaf comprising:

a first panel having an upper surface and a lower surface having means for clamping to a table, a first end and a second end, the first end having a ridge, the second end having attachment means;

a second panel having an upper surface and a lower surface having means for clamping to a table, a first end and a second end, the first end having a ridge, the second end having attachment means;

track means for allowing telescoping motion, said track means having a first and a second end, the first end of said track means being attached to the lower surface of said first panel, and the second end of said track means being attached to the lower surface of said second panel;

a splice panel having an upper surface, and a lower surface, the lower surface having an attachment means for mating with the attachment means of said first panel and the attachment means of said second panel, so that said first panel and said second panel may be placed over and adjusted along said track means to join a pair of round tables or a round table and a table having straight edges.

10. A table joining leaf according to claim 9 and further comprises a clamping means for connecting said.

11. A table joining leaf according to claim 10 wherein said first panel further comprises a thin substantially rigid material.

12. A table joining leaf according to claim 11 wherein said attachment means comprises hook and loop material.

13. A table joining leaf according to claim 12 wherein said first panel further comprises a clamping means for attaching to a table, the clamping means being attached to the lower surface of the first panel.

* * * * *